United States Patent [19]

Kenney

[11] 4,129,301

[45] Dec. 12, 1978

[54] GOLF PUTTING TRAINING DEVICE

[76] Inventor: Jerald R. Kenney, P.O. Box 1817, Crystal Bay, Nev. 89402

[21] Appl. No.: 828,839

[22] Filed: Aug. 29, 1977

[51] Int. Cl.[2] ..... A63B 69/36

[52] U.S. Cl. ..... 273/186 R; 273/127 A

[58] Field of Search ..... 273/127 A, 192, 186 R, 273/183 R, 183 E; 46/28, 29, 214

[56] References Cited

U.S. PATENT DOCUMENTS

| | | | |
|---|---|---|---|
| 2,693,663 | 11/1954 | Burchard | 46/28 |
| 2,710,488 | 6/1955 | Schaper | 46/28 |
| 2,945,315 | 7/1960 | Stockton | 46/29 X |
| 3,326,558 | 6/1967 | Eaton | 273/186 R X |
| 3,510,136 | 5/1970 | Ruspoli | 273/186 R X |

FOREIGN PATENT DOCUMENTS

| | | | |
|---|---|---|---|
| 218526 | 5/1957 | Australia | 273/192 |

*Primary Examiner*—George J. Marlo
*Attorney, Agent, or Firm*—Harris Zimmerman

[57] ABSTRACT

A golf putting training device includes a pair of inverted, generally U-shaped end members which are disposed in parallel spaced apart relationship and supported on a putting surface. A rod-like member extends from a lower edge portion of each of the end members to the distal end member where it is supported in selective dislodgement fashion by a detent recess. The end members also include a detent recess in the upper extent of their inverted U-configuration to receive another rod-like member, also for selective dislodgement. A golf ball is placed on the putting surface within the confines of the rod-like members, and the head of a putter is also placed within the confines to putt the ball through one of the inverted U-end members. A putting stroke which includes undesirable arc or side motion will cause the rod members to dislodge.

3 Claims, 3 Drawing Figures

GOLF PUTTING TRAINING DEVICE

BACKGROUND OF THE INVENTION

Those individuals who pursue a tiny white ball across vast expanses of real estate, that is those who partake in the sport of golf, are always searching for ways to increase their proficiency in the sport. Many devices are known in the prior art for increasing the accuracy and distance of drives, proficiency with irons, and the like.

Many players are dismayed to find that they can cover the enormous distance from tee to green in fewer shots than is required to move the ball from green to cup. Indeed, putting is often thought to be the most demanding part of the golfer's game. The putting stroke requires a very sensitive touch, exquisite control, and extreme patience.

It is generally believed that in the ideal putting stroke the head of the putter translates linearly in the direction the ball is to travel. This is in contrast to other club strokes in which the head of the club describes an arcuate trajectory. The linear putting stroke imparts velocity to the golf ball in the desired direction without imparting any spin which would cause the ball to veer from its desired course.

There are many golf putting training devices known in the prior art. Generally speaking these devices are directed towards improving the accuracy of the putting game of the player by providing a target at which he may putt a golf ball. There is a dearth of devices which improve the golfer's putting game by teaching and promoting the linear putting stroke.

SUMMARY OF THE INVENTION

The present invention generally comprises a training device which is particularly adapted to cause a golfer to learn the correct linear putting stroke. It includes a pair of identical members, each having an end portion disposed in opposed parallel relationship to the other. Each end portion is provided with an inverted generally U-shaped configuration, with a rod-like member extending normally from a lower edge portion of each end portion. Each rod-like member extends to the end portion of the opposite member, and is supported by a detent formed in the inverted U-shaped portion. The detent is shallow, so that the rod-like member may be easily dislodged.

The invention also includes a longitudinally extending linear member which is disposed generally parallel to the rod-like members. Each of the inverted U-shaped portions is provided with a shallow detent recess in the apex thereof, to receive the longitudinally extending linear member. The linear member is also easily dislodged from its respective detents.

A golf ball is placed within the confines of the structure defined by the rod-like members and the longitudinally extending member, and the golf putting trainee attempts to putt the ball through the inverted U-shaped portion of one of the members. To do so, the trainee must carefully place the head of the putter within the structure, adjacent to the golf ball, and stroke the ball towards the end portion. The stroke of the head of the putter must be linear and directed in a line passing through the middle of the end portion. If not, the head of the putter will impinge on one of the rod-like members or on the longitudinally extending member, causing one or all of them to become dislodged. When a trainee masters the task of putting the ball from the structure through the end portion, the trainee has then learned the correct putting stroke.

THE DRAWING

DESCRIPTION OF THE PREFERRED EMBODIMENT

Figure 1:
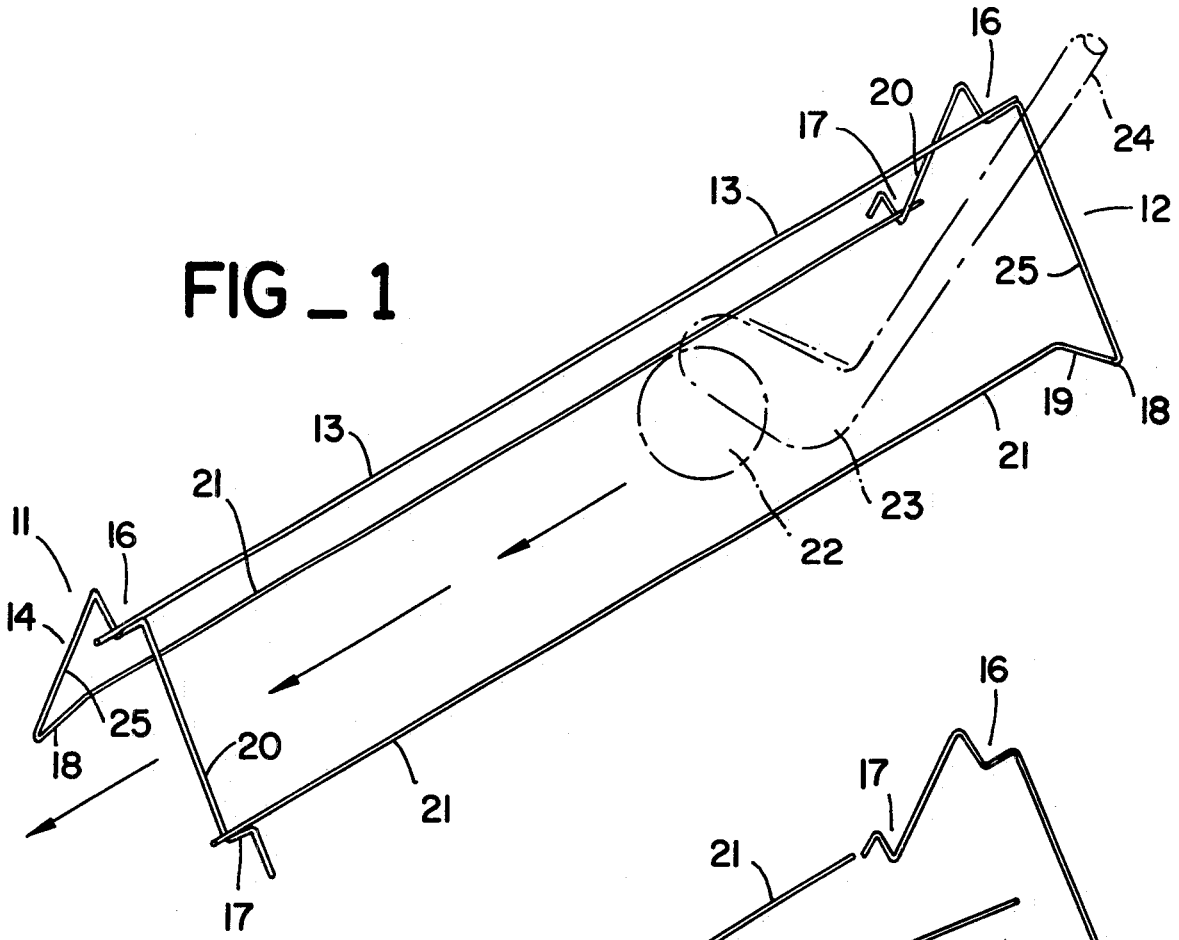
FIG. 1 is a perspective view of the golf putting training device of the present invention, shown in its assembled disposition.

As shown in FIG. 1, the preferred embodiment of the present invention includes a pair of members 11 and 12, and a longitudinally extending linear member 13. These members are assembled together to form a golf putting training device.

Each of the members 11 and 12 includes an end portion 14 which is provided with an inverted, generally U-shaped configuration. Disposed in the apex of the inverted U-shaped portion is a shallow, V-shaped detent recess 16. One leg 20 of the end portion 14 includes another shallow, V-shaped detent recess 17 at a lower distal portion thereof. The distal end of the leg 20 is ground-engaging.

The other leg 25 of the end portion 14 is provided with a small radius U-shaped bend 18 at the distal end thereof, the bend 18 forming a foot which is ground-engaging. Extending integrally from the bend 18 and parallel to the leg 25 is a short side member 19.

Extending from the side member 19 is a longitudinally disposed rod-like member 21. As shown in FIG. 1, the end portions 14 of the members 11 and 12 are in opposed parallel relationship, and the rod-like members 21 of each member 11 and 12 are supported by the detent recess 17 of the end portion of the opposed member. Likewise, the longitudinally extending linear member 13 extends between the end portions of the members 11 and 12, and is supported by the detent recesses 16 thereof. Due to the fact that the detent recesses 16 and 17 are shallow, the rod-like members 21 and the member 13 may be easily dislodged.

To employ the present invention as a golf putting training device, the putting trainee places a golf ball 22 within the confines of the structure of the present invention, as defined by the end portions, the members 21, and the member 13. The head 23 of a putter is then placed within the confines of the structure, with the shank 24 of the putter extending between the member 13 and one of the members 21. The golf putting trainee then attempts to putt the golf ball 22 from its medial position within the structure through one of the end portions 14. Due to the dimensions of the end portions 14, the spacing between the members 21 and the member 13 is such that there is very little room for the head 23 of the putter to be moved without striking one of the members 21 or 13 and causing the dislodgement thereof. Indeed, the only way in which the head of the putter may be moved without causing dislodgement is to translate the head of the putter linearly toward one of the end portions 14. Thus, the golf putting trainee is constrained to perform a linear putting stroke, if dislodgement is to be avoided.

Figure 2:
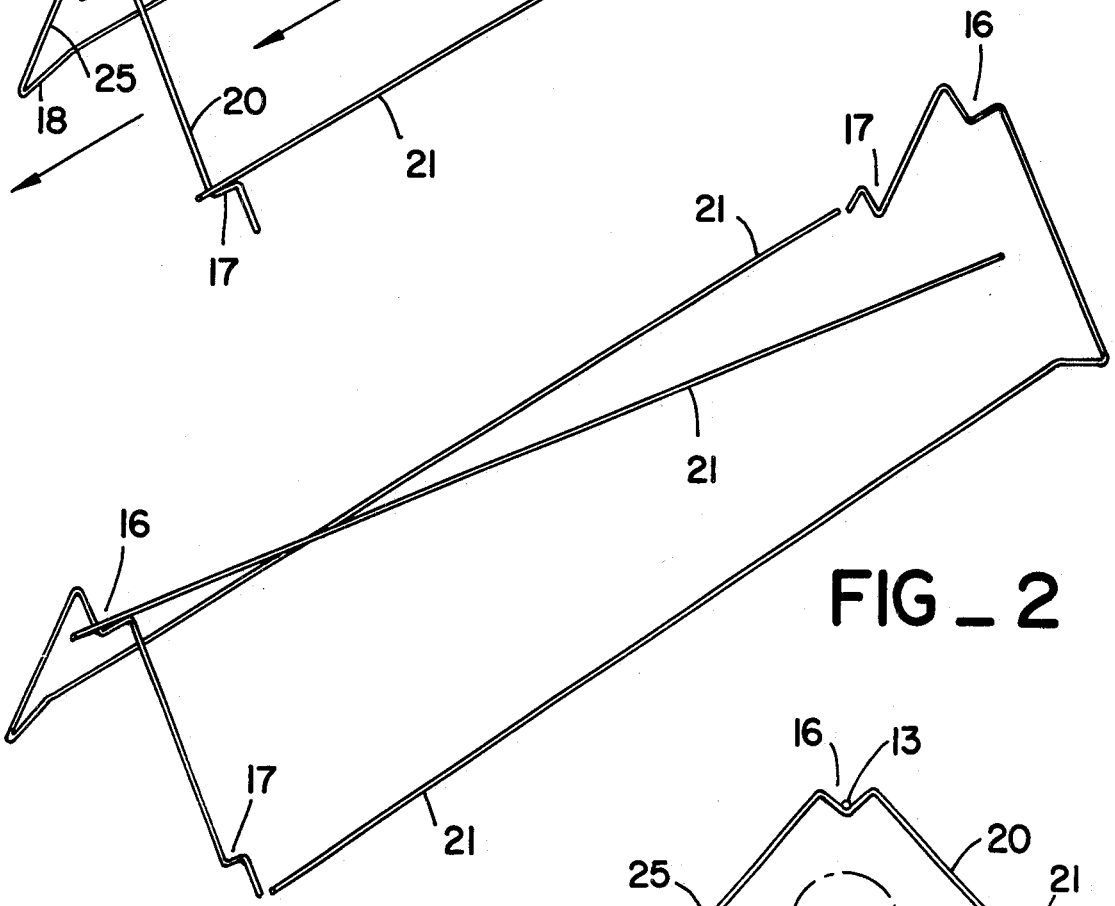
FIG. 2 is a perspective view of the golf putting training device of the present invention, shown in a dislodged disposition.
Figure 3:
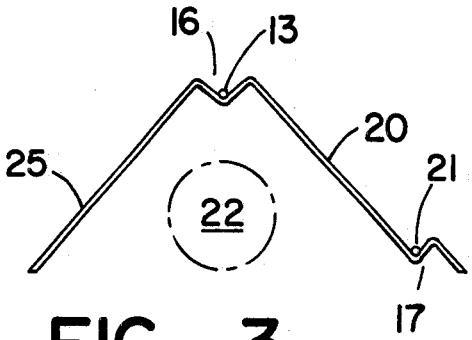
FIG. 3 is an end view of the golf putting training device of the present invention.

In one form of the present invention, the members 11, 12, and 13 are formed of wire which is bent in any appropriate manner to form the members 11, 12, and 13. Should any of the members be dislodged as shown in FIG. 2, the wire members striking the ground will resound and apprise the trainee of a poorly stroked putt.

The members 11, 12, and 13 of the present invention are easily assembled and disassembled, so that the device may be quickly set up to enable the putting trainee to practice during any idle moments. The device may be used indoors on carpet or hard floors, or outdoors on hard surfaces or putting greens.

I claim:

1. A golf putting training device comprising a pair of end members each formed to define an inverted U-portion with an integral leg extending generally orthogonally from one end of each of said inverted U-portions, a first detent formed in the other end of each of said U-portions; said end members disposed in parallel, spaced relationship with said leg of each resting in said first detent of the other and disposed for selective dislogement therefrom by an imperfect putting stroke carried out between said legs and said inverted U-portions.

2. The golf putting training device of claim 1, further including a second detent disposed in the upper extent of each of said inverted U-portions, and a rod-like member supported in said second detents generally parallel to said legs and spaced upwardly therefrom, said rod-like member also adapted for selective dislogement by an imperfect putting stroke carried out between said legs and said inverted U-portions.

3. The golf putting training device of claim 1, wherein each of said end members is integrally formed of a rod-like material.

* * * * *